US010102990B2

(12) United States Patent
Wrede et al.

(10) Patent No.: US 10,102,990 B2
(45) Date of Patent: Oct. 16, 2018

(54) ON-LOAD TAP CHANGER

(71) Applicant: Maschinenfabrik Reinhausen GmbH, Regensburg (DE)

(72) Inventors: Silke Wrede, Zeitlarn (DE); Eduard Schmidt, Lengfeld/Bad Abbach (DE)

(73) Assignee: MASCHINENFABRIK REINHAUSEN GMBH, Regensburg (DE)

( * ) Notice: Subject to any disclaimer, the term of this patent is extended or adjusted under 35 U.S.C. 154(b) by 169 days.

(21) Appl. No.: 14/898,748

(22) PCT Filed: Jun. 24, 2014

(86) PCT No.: PCT/EP2014/063255
§ 371 (c)(1),
(2) Date: Dec. 16, 2015

(87) PCT Pub. No.: WO2015/007472
PCT Pub. Date: Jan. 22, 2015

(65) Prior Publication Data

US 2016/0133406 A1 May 12, 2016

(30) Foreign Application Priority Data

Jul. 16, 2013 (DE) ..... 10 2013 107 550

(51) Int. Cl.
*H01H 19/00* (2006.01)
*H01H 21/00* (2006.01)
(Continued)

(52) U.S. Cl.
CPC ..... *H01H 33/6661* (2013.01); *H01H 9/0016* (2013.01); *H01H 9/0027* (2013.01);
(Continued)

(58) Field of Classification Search
CPC .. H01F 29/04; H01H 33/6661; H01H 9/0016; H01H 9/0027; H01H 9/0038;
(Continued)

(56) References Cited

U.S. PATENT DOCUMENTS 4,978,815 A 12/1990 Berger
5,107,200 A 4/1992 Dohnal
(Continued)

FOREIGN PATENT DOCUMENTS

DE 1917692 A 10/1970
DE 4231353 A 4/1993
(Continued)

*Primary Examiner* — Anthony R. Jimenez
(74) *Attorney, Agent, or Firm* — Andrew Wilford

(57) ABSTRACT

A load selector has a load changeover switch insert with a switching tube rotatable about an axis, at least one switching segment fastened to the switching tube, and at least two vacuum interrupters in the at least one switching segment. Each vacuum interrupter has a switching tube having a respective axially movable contact that cooperates at its free end with an actuating lever. The vacuum interrupters are so arranged in alternation in opposite sense that the movable contacts of the at least two vacuum interrupters are movable with respect to the axis alternately in opposite directions.

15 Claims, 9 Drawing Sheets

(51) Int. Cl.
*H01H 33/666* (2006.01)
*H01H 9/00* (2006.01)

(52) U.S. Cl.
CPC ... *H01H 9/0038* (2013.01); *H01H 2009/0022* (2013.01); *H01H 2009/0055* (2013.01)

(58) Field of Classification Search
CPC ... H01H 2009/0022; H01H 2009/0055; H01H 19/00; H01H 21/00; H01H 15/00; H01H 3/00; H01H 3/02; H01H 3/20; H01H 3/001; H01H 3/3042; H01H 3/32; H01H 3/38; H01H 3/54; H01H 9/0044; H01H 69/00; H01H 71/00; H01H 71/02; H01H 71/0214; H01H 71/025; H01H 71/0264; H01H 71/0271; H01H 71/10; H01H 71/1072; H01H 71/128; H01H 71/50; H01H 71/52; H01H 71/521; H01H 71/522; H01H 71/523; H01H 71/524; H01H 73/06; H01H 73/24; H01H 73/38; H01H 73/50; H01H 73/60; H01H 2003/02; H01H 2009/20; H01H 2009/0005; H01H 2009/0016; H01H 2009/0044; H01H 9/0005; H01H 9/0011; H01H 9/0033; H01H 9/0061; H01H 3/22; H01H 3/30; H01H 3/3031; H01H 3/40; H01H 3/42; H01H 3/46; H01H 19/12; H01H 2003/00; H01H 19/02; H01H 19/22; H01H 19/30
USPC ..... 200/11 TC
See application file for complete search history.

(56) References Cited

U.S. PATENT DOCUMENTS

| | | | | |
|---|---|---|---|---|
| 5,834,717 | A | 11/1998 | Neumeyer | |
| 2014/0027257 | A1* | 1/2014 | Albrecht | H01F 29/04 200/5 R |

FOREIGN PATENT DOCUMENTS

| | | | |
|---|---|---|---|
| DE | 102007004530 | A | 9/2007 |
| EP | 1078380 | A | 2/2001 |
| GB | 2049288 | A | 12/1980 |
| JP | 09063868 | A | 3/1997 |
| WO | 2010142680 | A | 12/2010 |
| WO | 2012003863 | A | 1/2012 |

* cited by examiner

ON-LOAD TAP CHANGER

CROSS REFERENCE TO RELATED APPLICATIONS

This application is the US-national stage of PCT application PCT/EP2014/063255 filed 24 Jun. 2014 and claiming the priority of German patent application 102013107550.9 itself filed 16 Jul. 2013.

FIELD OF THE INVENTION

The present invention relates to a load selector. The present invention relates particularly to a load selector that comprises a switching tube rotatable about an axis, at least one switching segment fastened to the switching tube and at least two vacuum interrupters. The vacuum interrupters are arranged in the at least one switching segment. Each vacuum interrupter has, in the direction of the axis of the switching tube, a movable contact that cooperates at its free end with an actuating lever.

BACKGROUND OF THE INVENTION

Load selectors of that kind belong to on-load tap changers (in abbreviation OLTC) and are widely known and conventional in the prior art. They serve for uninterrupted switching over between different winding taps of tapped transformers.

In general, on-load tap changers are actuated by a motor drive for switching over. A drive output or input shaft that draws up a force-storing unit is moved by the motor drive. When the force-storing unit is completely drawn up, i.e. stressed, it is unlatched, abruptly releases its energy and actuates, in a space of milliseconds (ms), a load changeover switch insert that then executes a specific switching sequence during the load changeover. In that case, different control contacts, also called switch contacts, and resistance contacts are then actuated in a specific time sequence. The control contacts serve for direct connection of the respective winding tap with the load diverter and the resistance contacts for temporary connection, i.e. bridging over, by means of one or more switching-over resistances. With advantage, vacuum interrupters (vacuum switching cells) are used as switching elements for the load changeover. This is due to the fact the use of vacuum interrupters for the load changeover prevents formation of arcs in the oil and thus oil contamination of the load changeover switch oil, such as described in, for example German Patent Specifications DE 195 10 809 C1 and DE 40 11 019 C1 as well as German published specifications DE 42 31 353 A1 and DE 10 2007 004 530 A1.

It is known from the prior art to arrange a plurality of vacuum interrupters in the same sense and upright on contact supports or contact housings of a load selector. In that case, by the term "same sense" there is meant in the context of the invention described in the following that the movable actuating contacts of all vacuum interrupters of a load selector can be moved only in one direction in order to make or break the electrical contact in the vacuum interrupter.

European Patent Specification EP 1 078 380 B1 describes, by example, a load selector for tapped transformers, wherein several vacuum interrupters are arranged annularly and in the same sense upright on contact supports, since the contact arrangement consists of several tap contacts fixedly arranged in a circle at a cylinder. The contact supports comprise wiper contacts guided by rollers in a diverter ring. The vacuum interrupters are controlled by control cams in this diverter ring (actuating element). In particular, the vacuum interrupters are each controlled by a lower cam track and an upper cam track. The two cam tracks (control cams) are respectively arranged on a concentric circle at the level of the actuating contacts (actuating plungers) of the vacuum interrupters. The two concentric circles lie immediately and directly adjacent to one another so that they together form an upper circular disk in which exclusively the actuating plungers of the vacuum interrupters are disposed. The lower ends of the vacuum interrupters without actuating plungers are disposed opposite on the contact support and form a lower circular disk without actuating contacts. The two circular discs are spaced apart and the middle parts such as, for example, the bellows, of the vacuum interrupters are arranged therebetween.

In CN 101320650 A, CN 101154497 A, DE 2020 1100963 U1, DE 2914928 C2, DE 3833126 A1, WO 2010/142680 A1 and WO 2012/003863 A1 the vacuum interrupters are similarly annularly arranged in the same sense with a control ring that comprises one or two directly and immediately adjacent annular cam tracks.

The vacuum interrupters usually taper in the direction of the actuating elements, whereas they widen in the direction of the opposite ends. The external shape of the vacuum interrupters is thus usually at least approximately conical. A disadvantage of this external shape in load selectors with vacuum interrupters arranged in the same sense is that the oil tank (insulating cylinder, contact cylinder) of the load selector, in which oil tank the vacuum interrupters are arranged in opposite sense, has to have a large diameter so that the load selectors correspondingly are less compact and less space-saving.

OBJECT OF THE INVENTION

It is therefore the object of the invention to create a compact and space-saving load selector that can always execute the same predetermined switching sequences and in addition utilizes a limited constructional space in assembly-friendly and service-friendly manner.

SUMMARY OF THE INVENTION

The on-load tap changer according to the invention comprises a load changer switch insert with a switching tube rotatable about an axis, at least one switching segment fastened to the switching tube and at least two vacuum interrupters. The at least two vacuum interrupters are arranged in the at least one switching segment. Each vacuum interrupter has, in the direction of the axis of the switching tube, a movable contact that cooperates at its free end with an actuating lever. According to the invention the vacuum interrupters are so arranged in alternation in opposite sense that the movable contacts of the vacuum interrupters are movable with respect to the axis of the switching tube alternately in opposite directions. In particular, this means for vertically arranged on-load tap changers that the movable contacts of the vacuum interrupters in each switching segment are oriented upwardly and downwardly in alternation and the fixed contacts of the vacuum interrupters are, conversely, correspondingly similarly oriented upwardly and downwardly (see FIGS. 5 and 6). Such an arrangement is space-saving, since the approximately conical vacuum interrupters are so arranged adjacent to one another in alternation that the 'cone tips' with the free ends of the movable contacts are arranged near the 'cone bases' with the fixed ends of the vacuum interrupters. The constructional space of the load selector can be better utilized by this arrangement. Less material has to be used in the production of such a compact load selector, which reduces not only production costs of the load selector, but also siting costs of the load selector.

In one form of embodiment of the load selector according to the invention each switching segment comprises a contact support in which movable contacts for a diverter/guide ring, movable contacts for at least one tap contact and the at least two vacuum interrupters are mounted.

In a further form of embodiment of the load selector according to the invention the contact support is further constructed with a bearing block for each actuating lever. The contact support together with the bearing block is preferably produced integrally from plastics material. The contact support can comprise a pivot axle transverse to the axis of the switching tube. In this case the contact support preferably has an upper housing part and a lower housing part, between which the vacuum interrupters are inserted into the contact support alternately in opposite sense. This means that with respect to adjacent vacuum interrupters in alternation a movable contact passes by the free end of the respective vacuum interrupter through the upper housing part or through the lower housing part. Conversely, a fixed end of the respective vacuum interrupter is correspondingly fastened in alternation in the lower housing part or in the upper housing part.

In one form of embodiment, each switching segment has two vacuum interrupters.

In one form of embodiment of the load selector according to the invention an actuating element for actuation of the actuating lever is associated with each switching segment. In that case, the actuating element is arranged at an inner wall of an oil tank. At least two control cams, namely an upper and a lower control cam, for mechanical actuation of the actuating levers of the vacuum interrupters are formed in the actuating element at opposite ends of the actuating element. The actuating levers are correspondingly arranged with respect to the free ends of the movable contacts of the vacuum interrupters in alternation oppositely in the switching segment.

In a further economic and space-saving form of embodiment of the load selector according to the invention the actuating element is integral and matched to the contour of the inner wall of the oil tank. In addition, the actuating element is formed with the upper control cam and the lower control cam. The integral actuating element can be produced from, for example, plastics material, in particular, for example, by an injection-molding process or a shaping process.

Each actuating lever of a switching segment carries a roller that cooperates with the upper control cam or with the lower control cam of the actuating element. An operating end of the actuating lever is in operative connection with the free end of the movable contact of the respective vacuum interrupter. At least two control lobes that cooperate with the rollers of the actuating levers, can be formed in each control cam.

In a further form of embodiment of the load selector according to the invention bores serving for fastening of the actuating element to the inner wall of the oil tank are provided in the actuating element. Screening caps at the outer wall of the oil tank mount, in cooperation with mounting elements of the tap contacts and the diverter/guide rings at the inner surface of the actuating element, the actuating elements on the inner wall of the oil tank.

In a further form of embodiment the load selector according to the invention comprises three phases. At least one switching segment and at least one actuating element are associated with each phase. In the first phase, at the inner surface of the corresponding actuating element a diverter/guide ring is an electrically conductive diverter contact that, for example, is led by an electrical terminal element through a screening cap to the outer wall of the oil tank. In the case of the second and third phases, at the inner surface of the corresponding at least one actuating element the diverter/guide ring consists of an electrically non-conductive material and is connected with a plurality of mounting elements at the inner surface of the corresponding actuating element. In all three phases an electrical terminal element of the respective tap contact is led to the outer wall of the oil tank via the respective screen cap and mounted by a mounting element on the inner surface of the corresponding at least one actuating element.

In a further form of embodiment of the load selector according to the invention the electrically conductive diverter contact of the first phase is a continuous wiper ring.

In further forms of embodiment of the load selector according to the invention the at least one switching segment of the first phase comprises a plurality of movable contacts for the diverter/guide ring and a plurality of movable contacts for the tap contacts and/or the at least one switching segment of the second and third phases comprises merely a plurality of movable contacts for the tap contacts.

BRIEF DESCRIPTION OF THE DRAWING

The invention and the advantages thereof are described in more detail in the following with reference to the accompanying drawings in which.

SPECIFIC DESCRIPTION OF THE INVENTION

Figure 1:
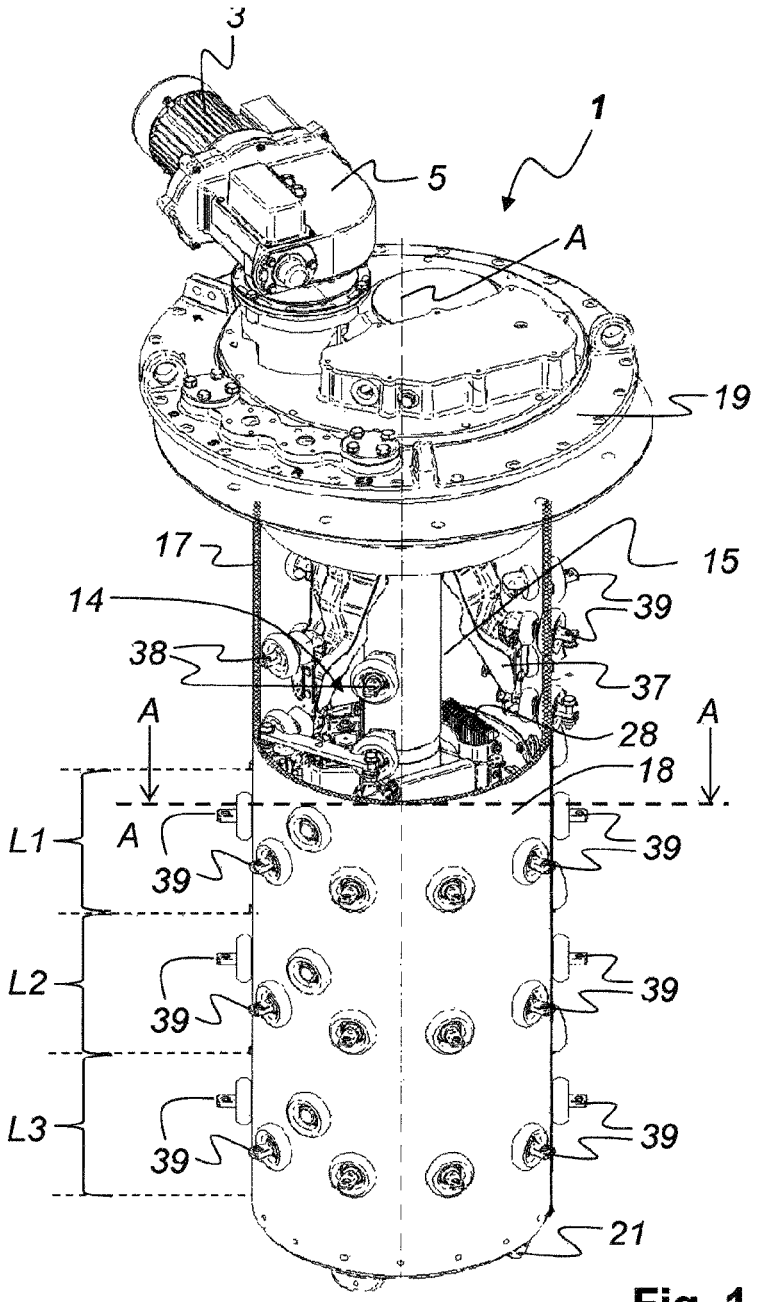
FIG. 1 shows a perspective view of a form of embodiment of the load selector according to the invention, wherein the load selector has three phases.

Identical reference numerals are used for the same or equivalent elements of the invention. In addition, for the sake of clarity only reference numerals are illustrated in the individual figures that are necessary for description of the respective figure. The illustrated forms of embodiment merely represent examples of how the load selector according to the invention can be and thus do not represent a definitive limitation of the invention.

FIG. 1 shows a perspective view of one form of embodiment of the on-load tap changer or load selector 1 according to the invention. The load selector 1 comprises a drive 3, such as, for example, an electric motor, with a transmission 5 that draws up a force-storing unit (not illustrated). When the force-storing unit is completely drawn up, i.e. stressed, it is unlatched, abruptly releases its energy and actuates a switching tube 15 of a load changeover switch insert 14. The switching tube 15 rotating about an axis Z is in that case mounted in an oil tank 18. The oil tank 18 is closed by a cover 19 and additionally carries a base 21.

The load selector 1 according to the invention has in one form of embodiment, as illustrated in FIG. 1, a first phase L1, a second phase L2 and a third phase L3 that are arranged one above the other in the oil tank 18. Seated above the three phases L1, L2, L3 is a preselector 37. In the view illustrated here, electrical terminal elements 38 for preselector contacts are provided at the oil tank wall 17 of the oil tank 18. Electrical terminal elements 39 for tap contacts 392 (see FIGS. 5 and 6) of the three phases L1, L2, L3 are similarly arranged at the load selector 1 in such a way that they pass through the oil tank wall 17 of the oil tank 18.

Figure 2:
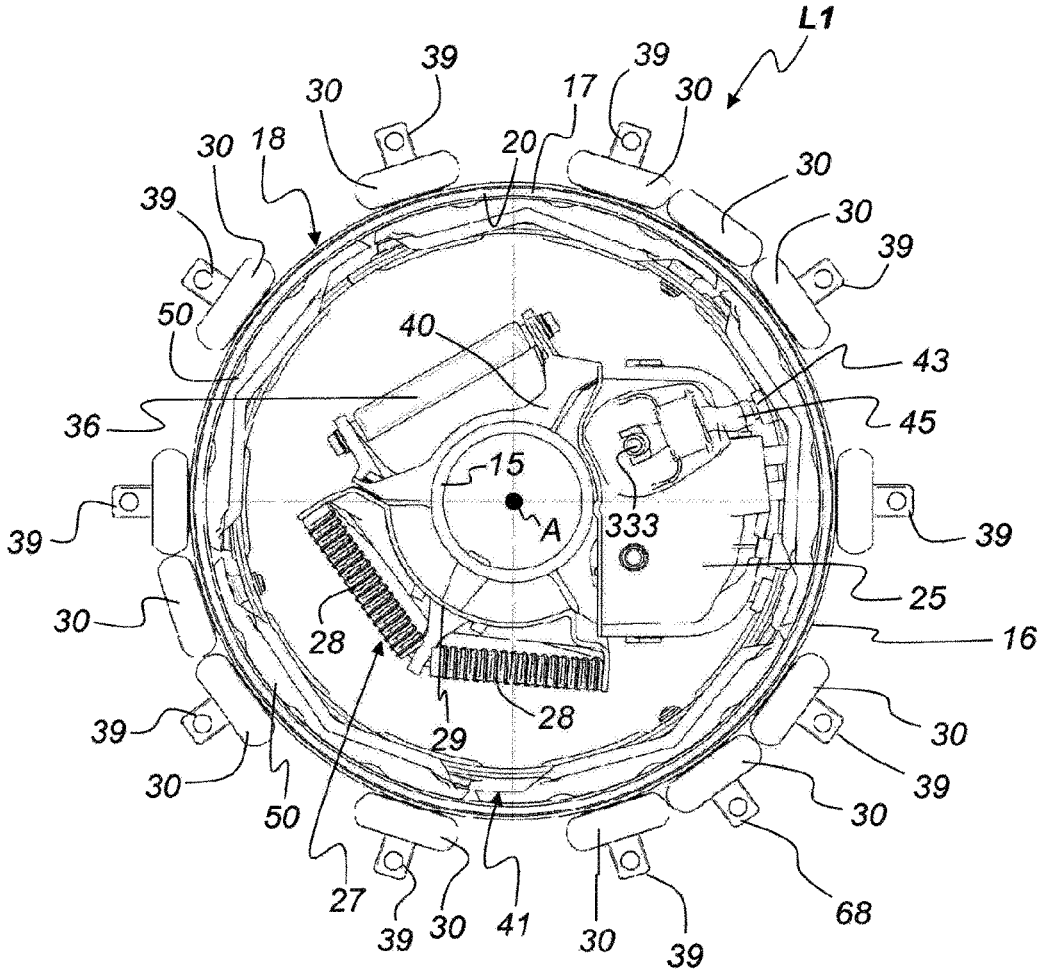
FIG. 2 shows a sectional view of the load selector along the section line A-A drawn in FIG. 1.
Figure 5:
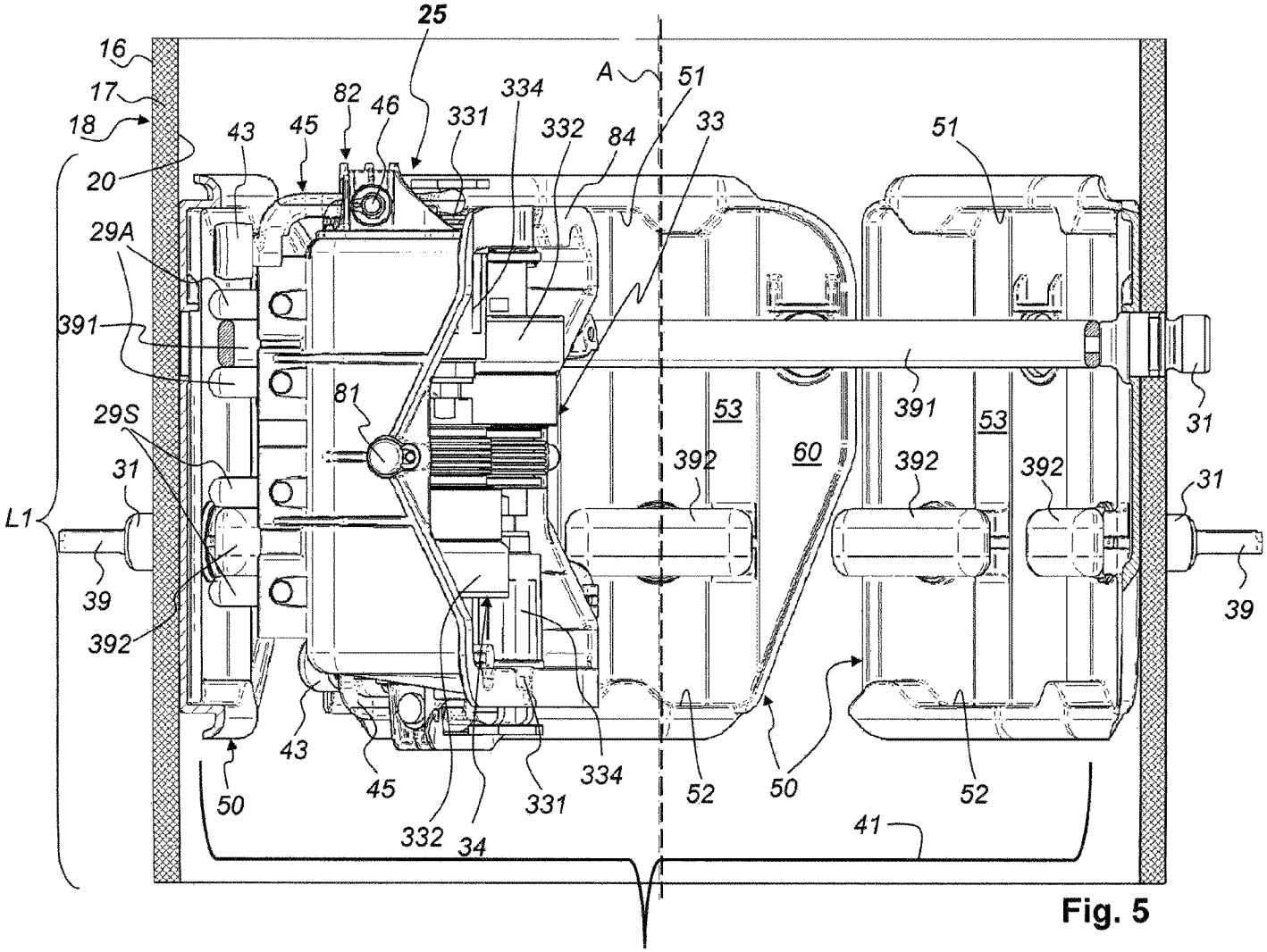
FIG. 5 shows a sectional view of a detail of the first phase of one form of embodiment of the load selector according to the invention.
Figure 6:
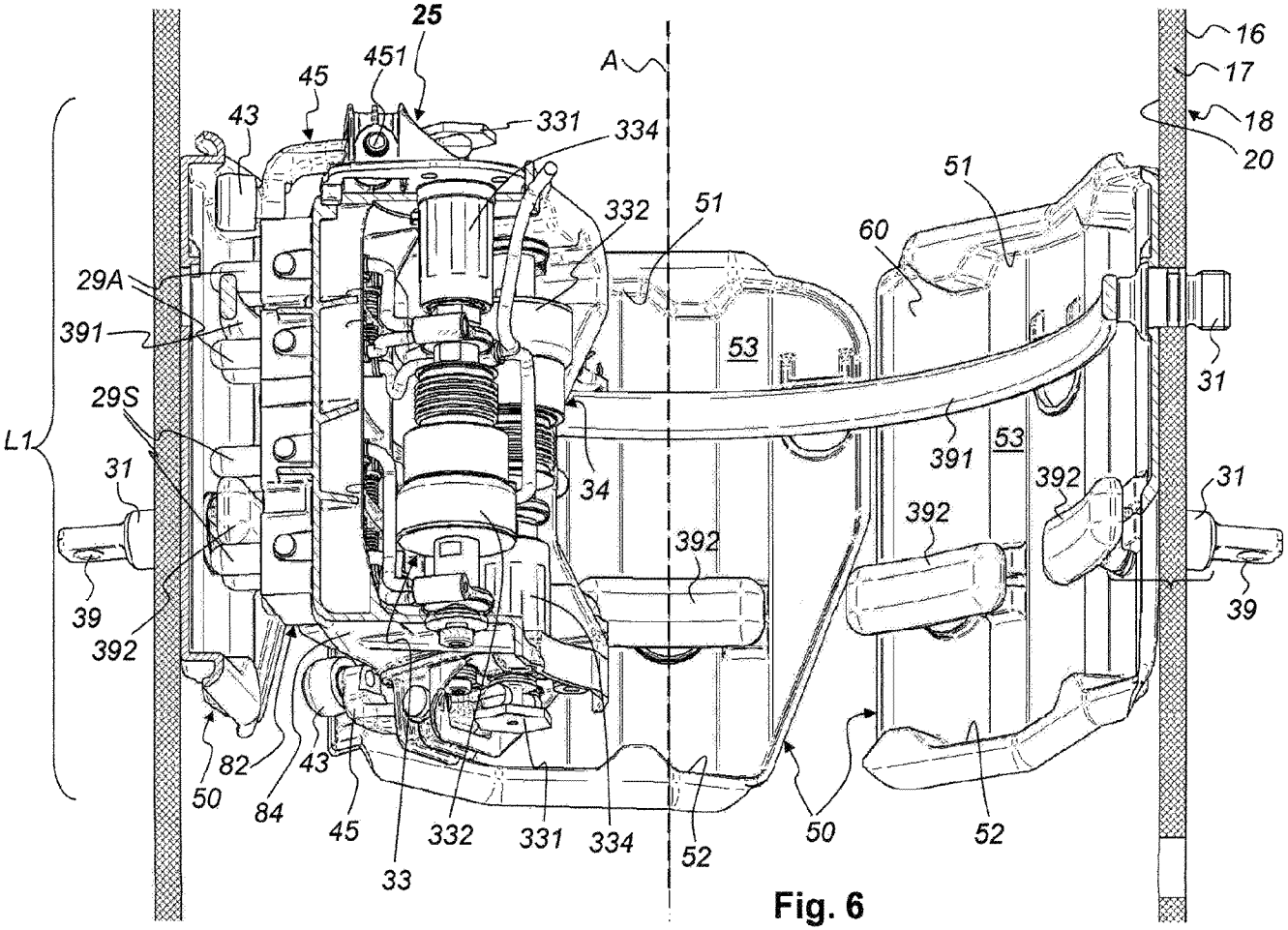
FIG. 6 shows a perspective view of the detail of the load selector of FIG. 5.

Preferably, at least one switching segment 25 and at least one actuating element 50 are associated with each phase L1, L2, L3 (see, with respect thereto, FIGS. 2, 5, 6). The switching segments 25 are fastened to the switching tube 15.

FIG. 2 shows a sectional view along the line A-A of FIG. 1 of the load selector 1, in which a plan view of the first phase L1 is illustrated. Arranged at an inner wall 20 of the oil tank 18 are, for the first phase L1, several actuating elements 50 that are matched to the contour of the inner wall 20 of the oil tank 18 and that represent an actuating arrangement 41. The vacuum interrupters 33, 34 (see FIGS. 5 and 6) are actuated by means of the actuating elements 50. Electrical terminal elements 39 for the tap contacts 392 (see FIGS. 5 and 6) and an electrical terminal element 68 for a diverter contact 391 (constructed as a diverter ring) pass through the corresponding actuating elements 50 and through the oil tank wall 17 of the oil tank 18 to the outer wall 16. Screening caps 30 that cooperate with mounting elements (not illustrated), mount at the outer wall 16 of the oil tank 18 the actuating elements 50 arranged at the inner wall 20 of the oil tank 18. For that purpose, the electrical terminal elements 39 for the tap contacts (not illustrated here) or the mounting element 31 for the single electrical terminal element 68 for the diverter contact 391 of the first phase 391 cooperate by the screening caps 30 with the tap contacts or with the diverter contact 391, so that the actuating elements 50 are mounted on the inner wall 20 of the oil tank 18. The screening caps 30 lie on the outer wall 16 of the oil tank 18. Each of the actuating elements 50 is formed with at least two control cams 51, 52 (see FIG. 7) that cooperate with corresponding actuating levers 45 that are provided with rollers 43, of the switching segment 25 of the corresponding phase L1, L2, L3.

The switching tube 15 carries in each phase L1, L2, L3 a mount 40 at which the high-mass element 36, the resistance arrangement 27 with several individual resistance elements and the switching segment 25 are mounted. The switching segment 25 is in that case mounted in such a way that the rollers 43 of the actuating levers 45 cooperate with the corresponding control cams 51, 52 (see FIG. 7) of the actuating elements 50 for actuation of the respective vacuum interrupters 33, 34 (see FIGS. 5 and 6). The resistance elements 28 are seated in a sector-shaped support 29.

Figure 3:
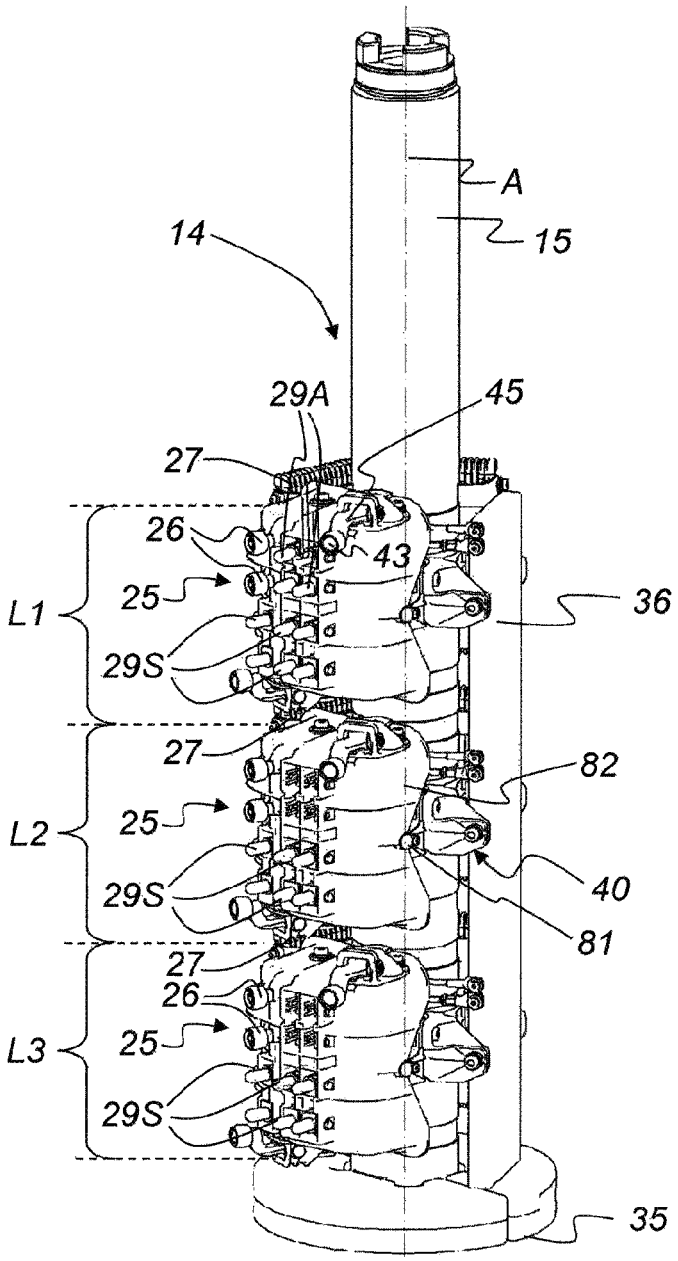
FIG. 3 shows a perspective view of the switching tube of the three-phase load selector according to FIG. 1, in which the three switching segments fastened to the switching tube and the high-mass element are to be seen.
Figure 4:
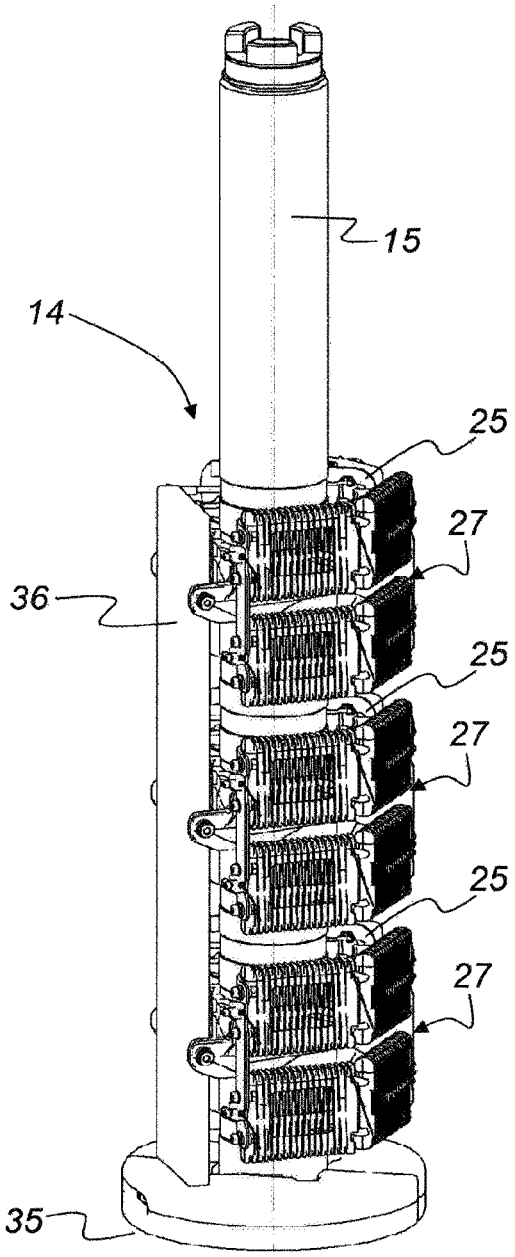
FIG. 4 shows a further perspective view of the switching tube of the three-phase load selector according to FIG. 1, in which the three resistance arrangements fastened to the switching tube and the high-mass element are illustrated.

FIGS. 3 and 4 show different perspective views of the load changeover switch insert 14 of the three-phase load selector 1 according to FIG. 1. Three switching segments 25 are fastened to the switching tube 15 of the load changeover switch insert 14 so that the load selector 1 is divided into the three phases L1, L2, L3. Besides the switching segments 25, resistance arrangements 27 that are associated with the individual phases L1, L2, L3 of the load selector 1, are similarly fastened to the switching tube 15. Through rotation of the switching tube 15, contacts 29S for tap contacts 392 or contacts 29A for the diverter/guide ring 391 can be directly connected. A predetermined switching sequence is realized by means of the control cams 51, 52 (see FIG. 7), so that a plurality of vacuum interrupters 33, 34 (see FIGS. 5 and 6) in the individual switching segments 25 are opened or closed.

The movable contacts 29A for the diverter/guide ring 391 of the first phase L1 and the movable contacts 29S for the tap contacts 392 are constructed as fingers in the form of embodiment illustrated here.

Each switching segment 25 has guide rollers 26 that are arranged oppositely in pairs and between that the diverter/guide rings 391 (see FIGS. 5 and 6) or all phases L1, L2 and L3 are respectively guided. As a result, guidance of the individual switching segments 25 on rotation of the switching tube 15 is also achieved.

A flywheel mass 35 is mounted on the switching tube 15. In addition, a high-mass element 36 is mounted on the switching tube 15. The high-mass element 36 can preferably be in mechanical and/or electrical contact with the flywheel mass 35. It is of advantage if the high-mass element 36 similarly has electrical conductivity. This can be provided by the high-mass element 36 itself or the high-mass element can carry appropriate conductor arrangements for that purpose. The high-mass element 36 is needed for assisting the movement sequence of the switching process over time so that the triggering, which produces pivoting or rotation of the switching tube 15, of the force-storing unit (not illustrated) executes a defined switching or defined setting of the individual switching states of the load selector 1. As shown here, for each of the three phases L1, L2, L3 (see FIG. 2) a mount 40 that mounts the switching segment 25, the resistance arrangement 27 and the high-mass element 36, is fastened to the switching tube 15.

FIG. 5 shows a sectional view of a detail of the first phase L1 of a form of embodiment of the load selector 1 according to the invention. FIG. 6 shows a perspective view of the detail of the load selector of FIG. 5. As already described in the preceding, the load selector 1 according to the invention comprises a load changeover switch insert 14 with a switching tube 15 rotatable about an axis A, at least one switching segment 25 fastened to the switching tube 15 and at least two vacuum interrupters 33, 34 that are arranged in the at least one switching segment 25. Each vacuum interrupter 33, 34 has, in the direction of the axis A of the switching tube 15, a movable contact 334 that cooperates at its free end 331 with an actuating lever 45.

According to the invention the vacuum interrupters 33, 34 are so arranged in alternation in opposite sense that the movable contacts 334 of the at least two vacuum interrupters 33, 34 are movable with respect to the axis A alternately in opposite directions. In particular, this means for vertically arranged on-load tap changers that the movable contacts are oriented in alternation upwardly and downwardly by the free ends 331 of the vacuum interrupters 33, 34 in the respective switching segment 25 and the fixed contacts or ends 332 of the vacuum interrupters 33 are, conversely, correspondingly similarly oriented downwardly and upwardly in alternation. This arrangement is space-saving and material-saving and optimally utilizes the constructional space of the load selector 1, as already described above. In particular, the vacuum interrupters 33, 34 are arranged in the switching segment 25 parallel to one another and parallel to the axis A of the switching tube 15.

At least one actuating element 50 for actuation of the actuation levers 45 of the vacuum interrupters 33, 34 is preferably associated with each switching segment 25. The at least one actuating element 50 is arranged at an inner wall 20 of an oil tank 18. At least two control cams 51, 52 each for mechanical actuation of a respective actuating lever 45 of an individual vacuum interrupter 33, 34 are formed in the actuating element 50 at opposite ends of the actuating element 50. The actuating levers 45 are arranged in the switching segment 25 alternately in opposition in correspondence with the free ends 331 of the movable contacts 334 of the vacuum interrupters 33, 34. The upper and lower control cams 51, 52 cooperate with the rollers 53 of the respective actuating levers 45 of the switching segment.

With further preference, the actuating element 50 is integral and matched to the contour of the inner wall 20 of the oil tank 18 in that the control cams 51, 52 are formed or constructed at the opposite ends of the actuating element 50.

With further preference, bores 60 and passages 62 (see also FIG. 7) for fastening the actuating element 50 to the inner wall 20 of the oil tank 18 are provided in the identical actuating elements 50. In that case, in the first phase L1 illustrated in accordance with FIGS. 5 and 6 a corresponding electrical mounting element 31 with electrical terminal element (not illustrated) is led through the passage of each actuating element 50 for the diverter/guide ring 391, and in two further actuating elements 50 for the diverter/guide ring 391 each with a respective mounting element 31, to the outer wall 16 of the oil tank 18.

In the case of the second and third phases L2, L3 (see FIG. 2) instead of in the passage 62 of the corresponding actuating element 50 the guide rings 391 are connected with several mounting elements 31 that each cooperate by a respective screening cap 30 at the outer wall 16 of the oil tank 18. In that case, the diverter/guide ring 391 of the second and third phase L2, L3, by contrast with the diverter/guide ring 391 in the first phase L1, is not connected with an electrical terminal element, thus is merely a guide ring.

In all three phases L1, L2, L3 electrical terminal elements 39 of the respecting mounting elements 31 with tap contacts 392 are led to the outer wall 16 of the oil tank 18. The terminal elements 39 cooperate by mounting elements 31 with respective screening caps 30 at the outer wall 16 of the oil tank 18 so that the tap contacts 392 are mounted by means of a mounting element 31 in the bore 60 of the corresponding at least one actuating element 50.

According to the form of embodiment in accordance with FIGS. 5 and 6 the diverter/guide ring in the first phase L1 is an electrically conductive diverter contact 391 that is a continuous wiper ring. Each switching segment 25 has two vacuum interrupters 33, 34. The at least one switching segment 25 of the first phase L1 comprises several movable contacts 29A for the diverter/guide ring 391 and several movable contacts 29S for the tap contacts 392.

The at least one switching segment 25 of the second and third phases L2, L3 merely comprises several movable contacts 29S for the tap contacts 392 and, in this embodiment, no movable contacts 29A, since the diverter/guide ring 391 does not have an electrical diverter function as in the first phase L1, but is merely a guide ring.

Preferably, each actuating lever 45 of a switching segment 25 carries a roller 43 that cooperates with an upper control cam 51 or a lower control cam 52 of each actuating element 50 of the actuating arrangement 41. Each actuating lever 45 is pivotable about a pivot axis 46 so that one lever end of the actuating lever 45 actuates a movable contact 331 of the associated vacuum interrupter 33 or 34 and the other lever end of the actuating lever 45 that carries the roller 43, cooperates with the correspondingly associated control cam 51 or 52. The correspondingly associated actuating levers 45 are actuated by means of the upper control cam 51 and the lower control cam 52 and then transmit a movement to the movable contact 334 of the corresponding vacuum interrupter 33, 34.

Each switching segment 25 comprises a contact support 82 for the at least two vacuum interrupters 33, 34 and the movable contacts 29A and 29S. The contact support 82 is preferably produced integrally from plastics material. The contact support 82 further comprises a bearing block 47 for each actuating lever 45, wherein the contact support 82 together with the bearing block 47 is preferably made from plastics material.

A pivot axle 81 of the contact support 82 is, in addition, preferably arranged transversely to the axis A of the switching tube 15. This has the advantage that the switching segments 25 on installation of the load changeover switch insert 14 in the oil tank 18 come into operative connection, in particular by the movable contacts 29S for the tap contacts 392 of the switching segment 25, easily and securely with the tap contacts 392 or by the movable contacts 29A of the first phase L1 for the diverter/guide ring 391 with the diverter/guide ring 391.

Figure 7:
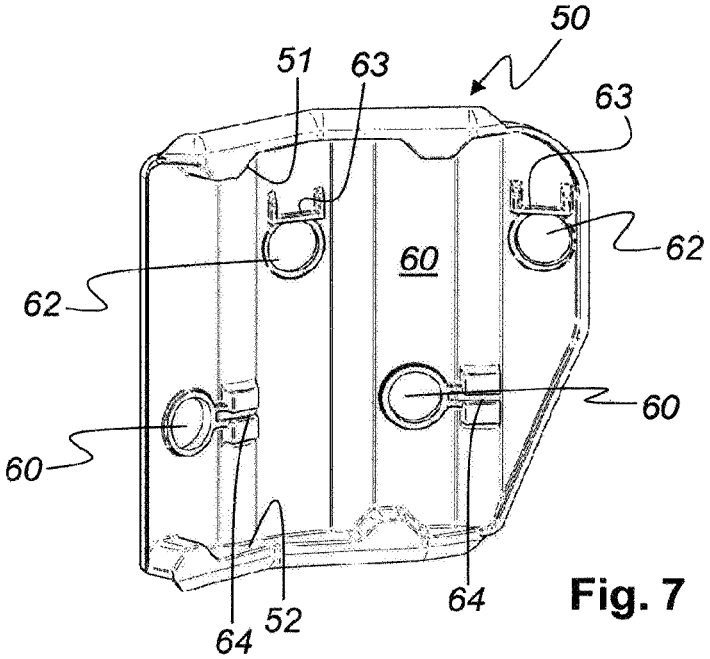
FIG. 7 shows a perspective view of an individual actuating element for the load selector according to the invention, in which the actuating element is matched to the contour of the inner surface of the oil tank.

FIG. 7 shows a perspective view of an individual actuating element 50 that is matched to the contour of the inner wall 20 of the oil tank 20. The actuating elements 50 used in accordance with the invention in the load selector 1 are of identical construction. The actuating element 50 has at least one bore 60 for the mounting and passage of the electrical terminal elements 39 of the tap contacts 392 (see FIGS. 5, 6) and the positioning of the actuating element 50. At least one respective positioning groove 61 is arranged at each bore 60 so as to precisely position a respective tap contact 392 and to prevent the tap contact 392 from turning during operation. According to a preferred form of embodiment each actuating element 50 is connected with the oil tank wall 17 by two tap contacts 392 that each comprise a respective mounting element 31 and an electrical terminal element 39 of the tap contact 392.

Moreover, each actuating element 50 has at least one passage 62 with a respective abutment 63. The passages 62 serve for guidance of a mounting element 31 or of a mounting element 31 with an electrical terminal element 68 for the diverter/guide ring 391, by which the diverter/guide ring 391 is fixed. The abutment 63 is constructed in such a way that the electrical terminal element 68 with mounting element 31 (see FIG. 9) or mounting elements 31 (see FIGS. 5 and 6) by themselves cooperate in such a way that these cannot be turned during mounting. The integral actuating element 50 is preferably produced from a plastics material and matched to the contour of the inner wall 20 of the oil tank 18.

Figure 8:
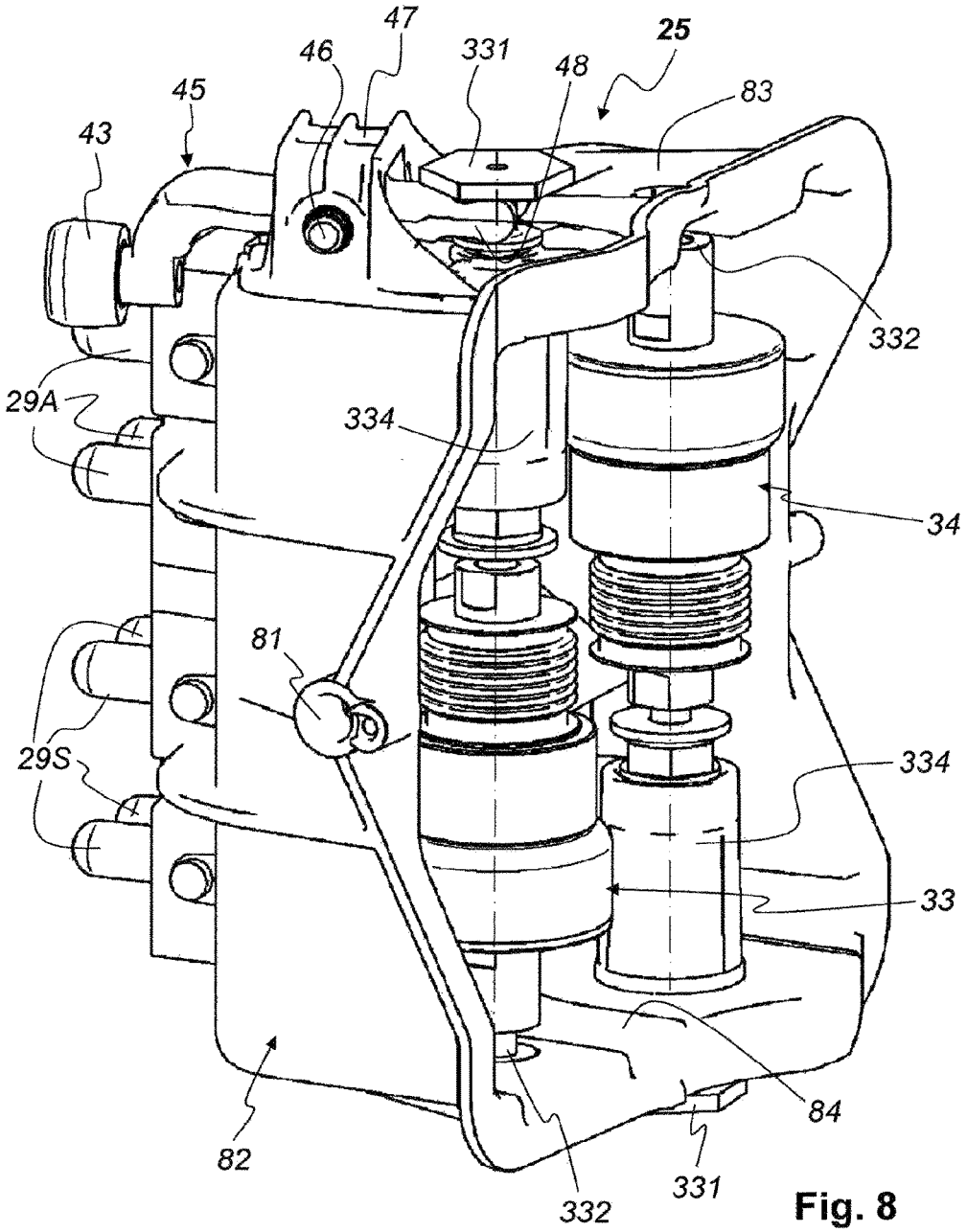
FIG. 8 shows a perspective view of an individual switching segment for the load selector according to the invention in accordance with FIGS. 5 and 6.
Figure 9:
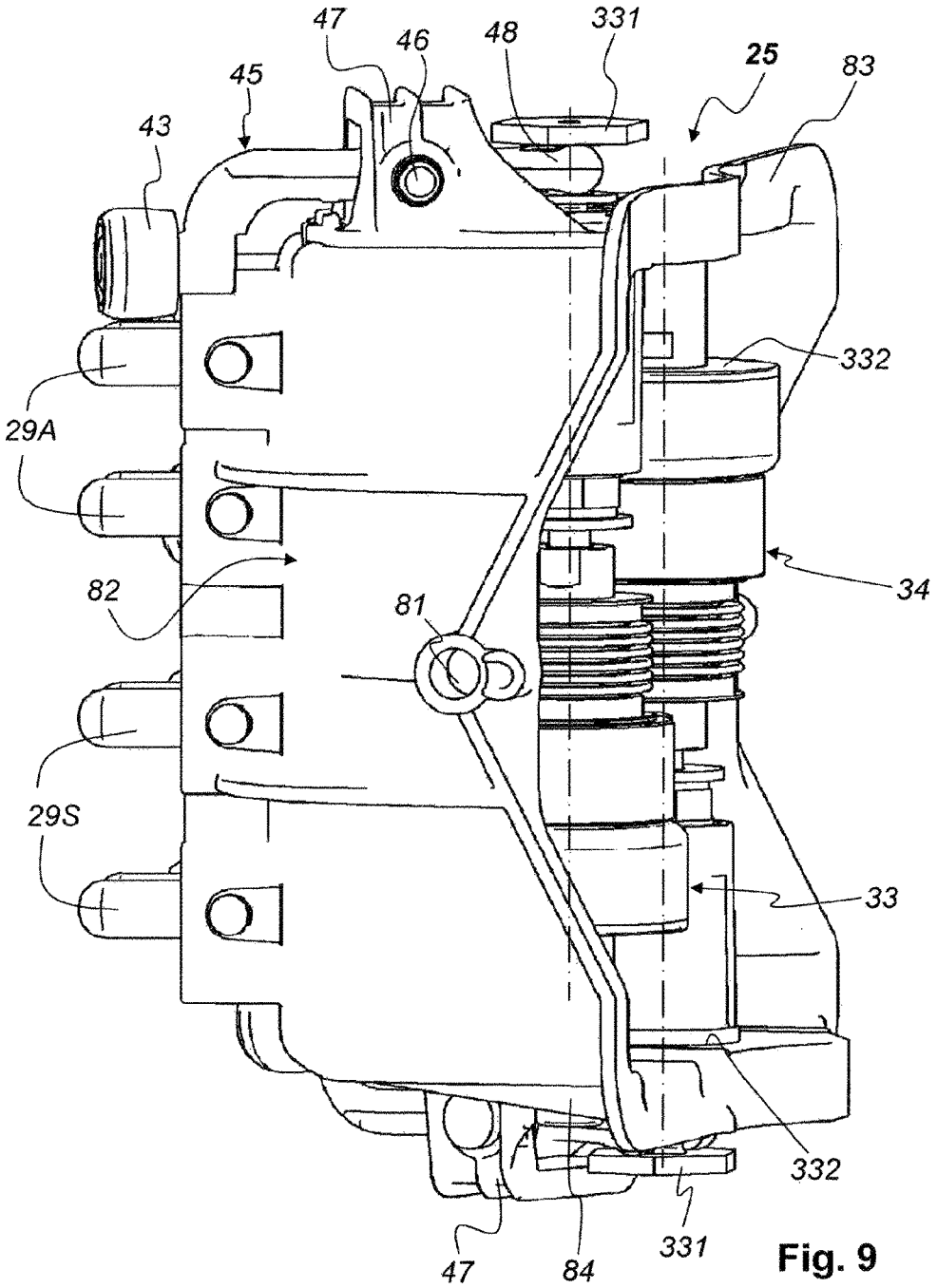
FIG. 9 shows a further perspective view of the switching segment according to FIG. 8.

FIG. 8 shows a perspective view of an individual switching segment 25 for the first phase L1 of the load selector 1 according to the invention in accordance with FIGS. 5 and 6. FIG. 9 shows a further perspective view of the switching segment 25 according to FIG. 8. All elements were already described beforehand.

In summary, the described contact support 82 is constructed as an inexpensive plastics material part for the vacuum interrupters 33, 34 that are arranged in opposite sense, and for the movable contacts 29A and 29S of the first phase L1 or the movable contacts 29S of the second and third phases L2 and L3. A more compact load selector 1 with a high level of functional integration and modular construction from switching segments 25 and actuating elements 50 is thus provided.

The contact support 82 is constructed with an upper housing part 83 and lower housing part 84, between which the vacuum interrupters 83, 84 are inserted into the contact support 82 in opposite sense in alternation. Thus, a movable contact 334 passes in alternation by the free end 331 of the respective vacuum interrupter 33, 34 through the upper housing part 83 or through the lower housing part 84. The vacuum interrupters 33, 34 respectively 10*o* have fixed ends 332 opposite the free ends 331. The fixed ends 332 are correspondingly conversely fastened in alternation in the lower housing part 84 or in the upper housing 83. According to a preferred form of embodiment two vacuum interrupters 33, 34 are arranged in alternation in opposite sense in the contact support 82.

The application was described with reference to a preferred embodiment. However, it will be obvious to any expert that modifications and changes can be undertaken without in that case departing from the scope of protection of the following claims. The embodiments explained in the foregoing serve merely for description of the claimed teaching, but do not restrict this to the embodiments. Thus, for example, it will be obvious to an expert that the arrangement in opposite sense of the vacuum interrupters 33, 34 in the load selector 1 according to the invention can also be undertaken in an on-load tap changer or load selector that is not of three phase.

The invention claimed is:

1. A load selector comprising:

a load changeover switch insert with a switching tube rotatable about an axis, at least one switching segment fastened to the switching tube, and at least two vacuum interrupters in the at least one switching segment, each vacuum interrupter a switching tube having a respective axially movable contact that cooperates at its free end with an actuating lever, the vacuum interrupters being so arranged that the movable contacts of the at least two vacuum interrupters are movable with respect to the axis alternately in opposite directions.

2. The load selector according to claim 1, wherein each switching segment has two vacuum interrupters.

3. The load selector according to claim 1, wherein each switching segment comprises a contact support in which movable contacts for a respective diverter/guide ring, movable contacts for at least one tap contact and the at least two vacuum interrupters can be mounted.

4. The load selector according to claim 3, wherein the contact support additionally carries a bearing block for each actuating lever.

5. The load selector according to claim 4, wherein the contact support and the bearing block are made from plastic.

6. The load selector according to claim 3, wherein the contact support comprises a pivot axle transverse to the axis of the switching tube.

7. The load selector according to claim 3, further comprising:

a load changeover switch insert with a switching tube rotatable about an axis, at least one switching segment fastened to the switching tube, and at least two vacuum interrupters in the at least one switching segment, each vacuum interrupter having a switching tube in turn having an axially movable contact that cooperates at its free end with an actuating lever, the vacuum interrupters being so arranged that the movable contacts of the at least two vacuum interrupters are movable with respect to the axis alternately in opposite directions, each switching segment comprises a contact support in which movable contacts for a respective diverter/guide ring, movable contacts for at least one tap contact, and the at least two vacuum interrupters can be mounted, the contact support comprising an upper housing part and a lower housing part, between which the vacuum interrupters are inserted into the contact support in opposite sense so that a movable contact passes by the free ends of the vacuum interrupters alternately through the upper housing part or through the lower housing part.

8. The load selector according to claim 7, wherein a fixed end of the vacuum interrupters is fastened alternately in the lower housing part or in the upper housing part.

9. A load selector comprising:

a load changeover switch insert with a switching tube rotatable about an axis;

at least one switching segment fastened to the switching tube, at least two vacuum interrupters in the at least one switching segment, each vacuum interrupter a switching tube in turn having an axially movable contact that cooperates at its free end with an actuating lever, the vacuum interrupters being so arranged such that the movable contacts of the at least two vacuum interrupters are movable with respect to the axis alternately in opposite directions, at least one actuating element for actuating the actuating lever associated with each switching segment and is mounted on an inner wall of an oil tank, and at least one upper control cam and lower control cam for mechanical actuation of the actuation levers of the vacuum interrupters formed in the actuating element, the actuating levers being in the switching segment oppositely and alternately in correspondence with the free ends of the movable contacts of the vacuum interrupter.

10. The load selector according to claim 9, wherein the actuating element is matched to the contour of the inner wall of the oil tank and is formed with the upper control cam and the lower control cam.

11. The load selector according to claim 9, wherein each actuating lever of a switching segment carries a respective roller that cooperates with the upper control cam or with the lower control cam of the actuating element, and an operating end of the actuating lever is in operative connection with the free end of the movable contact of the vacuum interrupter.

12. A load selector with first, second and third phases, the load selector comprising:

a load changeover switch insert with a switching tube rotatable about an axis, at least one switching segment fastened to the switching tube, and at least two vacuum interrupters in the at least one switching segment, each vacuum interrupter a switching tube in turn having an axially movable contact that cooperates at its free end with an actuating lever, the vacuum interrupters being so arranged that the movable contacts of the at least two vacuum interrupters are movable with respect to the axis alternately in opposite directions, wherein at least one switching segment and at least one actuating element are associated with each phase, in the first phase, a diverter/guide ring at an inner surface of the respective actuating element is an electrically conductive diverter contact, in the second and third phases, the diverter/guide ring at the inner surface of the respective actuating element is secured by a plurality of mounting elements at the respective actuating element, and in all three phases, an electrical terminal element of the respective tap contact extends through a respective screening cap to the outer wall of the oil tank and is mounted by a mounting element at the inner surface of the respective actuating element.

13. The load selector according to claim 12, wherein each diverter/guide ring is made of an electrically non-conductive material.

14. The load selector according to claim 12, wherein the at least one switching segment of a first phase comprises a plurality of movable contacts for the respective diverter/guide ring and a plurality of movable contacts for the respective tap contacts.

15. The load selector according to claim 12, wherein the at least one switching segment of a second and a third phase comprises merely a plurality of movable contacts for the tap contacts.

* * * * *